US006554200B1

(12) United States Patent
Satonaka

(10) Patent No.: US 6,554,200 B1
(45) Date of Patent: Apr. 29, 2003

(54) SYSTEM AND METHOD FOR REMOTELY MONITORING ARTIFICIAL SNOW MAKER OF ICE CRUSHING TYPE

(75) Inventor: Toshihide Satonaka, Hiroshima (JP)

(73) Assignee: Kabushiki Kaisha Piste Snow Industries, Tokyo (JP)

( * ) Notice: Subject to any disclaimer, the term of this patent is extended or adjusted under 35 U.S.C. 154(b) by 0 days.

(21) Appl. No.: 09/703,440

(22) Filed: Nov. 1, 2000

(51) Int. Cl.[7] ..... F25C 3/04

(52) U.S. Cl. ..... 239/2.2; 239/14.2; 239/67; 239/69; 239/75

(58) Field of Search ..... 239/67, 69, 75, 239/2.2, 14.2

(56) References Cited

U.S. PATENT DOCUMENTS 4,717,072 A * 1/1988 Girardin ..... 239/75
5,031,832 A 7/1991 Ratnik et al. ..... 238/14.2
5,400,965 A * 3/1995 Ratnik et al. ..... 239/14.2

FOREIGN PATENT DOCUMENTS

JP 405113277 A * 5/1993 ..... 239/14.2

* cited by examiner

*Primary Examiner*—Robin O. Evans
(74) *Attorney, Agent, or Firm*—Omori & Yaguohl USA, LLC

(57) ABSTRACT

The present invention provides a system capable of accurately monitoring each of a plurality of snowmakers of ice crushing type which are placed on a skiing ground. The system has a monitoring device, which is placed in a monitoring station of the skiing ground and is connected to each of the snowmakers for monitoring an operational state of each of the snowmakers. The system further includes an external monitoring device provided in an external monitoring station located in a remote place from skiing grounds. The external monitoring device is capable of monitoring an operational state of each of the snowmakers in a selected skiing ground, since it can be selectively connected to the monitoring device placed in each skiing ground.

11 Claims, 6 Drawing Sheets

SYSTEM AND METHOD FOR REMOTELY MONITORING ARTIFICIAL SNOW MAKER OF ICE CRUSHING TYPE

BACKGROUND OF THE INVENTION

1. Field of the Invention

The present invention relates to a remote monitoring system for artificial snow makers (artificial snowmakers) which are placed on a ski slope at predetermined intervals.

2. Description of the Related Art

An artificial snowmaker is used to solve a problem of natural snow shortages in such facilities as ski or snowboarding slopes, or to produce artificial snow in facilities where artificial snow is sparsely provided on a surface of an artificially created slope.

A spray- or gun-type artificial snowmaker is an example of this type. In a spray- or gun-type artificial snowmaker, snow-making water is sprayed into the air at a temperature below the freezing point of water, thereby turning into snow. In utilizing this type of artificial snowmaker, a plurality of artificial snowmakers are placed at predetermined intervals on a ski slope, and each artificial snowmaker is provided with a nozzle, through which the snow-making water that is supplied at a predetermined pressure is sprayed so as to cover a predetermined range of the slope.

A disadvantage of the artificial snowmaker described above is that it can be used only when the outdoor air temperature is below the freezing point. However, an artificial snowmaker of this type can be made with relatively simple structures because it is used only under limited conditions. Moreover, its operating time is fixed at a short period at night. Thus, an advantage of this type of artificial snowmaker is that its devices are easy to control and have few breakdowns.

A different type of artificial snowmaker can be used when the outdoor air is at room temperature. This type of artificial snowmaker is provided with a device that produces artificial snow by finely crushing pieces of ice to make snow-like flakes and discharges them with pressured air onto the slope. This device is called, for example, Ice Crushing System (trade name).

The ice crushing system has an advantage of being capable of making artificial snow regardless of outdoor air temperature because it is provided with a freezer where ice is produced. However, problems arise when the ice crushing system is used in an outdoor field.

When the ice crushing system is used in an outdoor field, it is required that the system be able to operate stably for a long period of time under variable environmental conditions on the ski slope where the system is placed. Furthermore, the system may be required to operate on an artificial ski slope on a beach during summer. Moreover, it should be noted that the environmental conditions outside of the system may vary greatly depending on the climate and time even if the system is placed in the same location.

Since it is difficult to operate the freezer that includes a compressor in a stable manner under such variable environmental conditions, there is a high possibility of occurrence of problems and malfunctions as compared to a spray-type artificial snowmaker. Consequently, an artificial snowmaker of ice crushing type requires far more frequent inspections, adjustments and maintenance than a spray-type artificial snowmaker.

Furthermore, when a great number of ice crushing systems are placed on a large skiing ground, it is necessary to have a certain number of staff engaged in a routine inspection of the systems, which requires enormous labor and cost. In addition, even when some abnormality is detected in one of the systems during a routine inspection, it may be difficult to fix the problem quickly when it requires replacement of parts. In this case, the staff must return to the base, find necessary parts and bring them back to the system for the repair.

SUMMARY OF THE INVENTION

The present invention has been achieved in consideration of the above-described circumstances of the prior art techniques, and an object thereof is to provide a system capable of accurately monitoring each of a plurality of ice-crushing type artificial snowmakers provided in a skiing ground.

A further detailed object of the present invention is to provide a system which allows an appropriate preparation before staff actually goes to the location of each of the artificial snowmakers for maintenance.

Another object of the present invention is to provide a system capable of monitoring artificial snowmakers in a selected skiing ground from a remote place.

In order to achieve the above objects, the present invention provides, according to the first aspect of the present invention, a system for remotely monitoring artificial snowmakers, comprising: a plurality of artificial snowmakers placed apart from each other on a slope of a skiing ground, each of the artificial snowmakers having a freezer for making ice, and being capable of making artificial snow independently; and a monitoring device provided in a monitoring station of the skiing ground and connected to each of the artificial snowmakers, for monitoring an operational state of each of the artificial snowmakers.

With the structure described above, it is possible to carefully monitor from the monitoring station ice-crushing type artificial snowmakers, which are prone to malfunctions caused by elements such as outdoor temperature. In this way, even if a malfunction occurs in one of the artificial snowmakers, it can be treated promptly and correctly.

Here, according to one embodiment of the present invention, the monitoring device is connected to a sensor provided in each of the artificial snowmakers, and the sensor comprises at least an atmosphere detection sensor to detect an atmosphere where an artificial snowmaker is placed, and a pressure detection sensor to detect a coolant pressure of the freezer. The monitoring device comprises a sensor detected value display means used to display a value detected by each of the sensors provided in the respective artificial snowmakers, and an operational state display means to display an operational state of each of the artificial snowmakers.

With the above-described structure, it is possible to monitor various parameters and the operational state of a compressor in the ice crushing type artificial snowmaker, which has greatly varying performance depending on environmental conditions in a skiing ground where the artificial snowmaker is in operation. Therefore it is possible to properly control the artificial snowmaker.

According to another embodiment, the monitoring device includes a time series display means to display the above-described sensor detected values and the operational states in a time series.

With the above-described structure, it is possible to display in a time-series table manner variations in the parameters of each artificial snowmaker that depend on elements such as temperature. This makes it easy to control and adjust each artificial snowmaker.

According to still another embodiment, the monitoring device further comprises a temperature sensor to detect temperature of lubricant for a compressor of the freezer.

With the above-described structure, it is possible to accurately detect the time when the coolant enters the compressor in the form of liquid, so that maintenance staff can have enough time to prepare for the artificial snowmaker stoppage.

According to still another embodiment, the monitoring device further comprises a location display device which displays a location where each of the artificial snowmakers is placed on a ski slope, and an abnormality display device which displays a sign indicating an abnormality on the location display device when some abnormality occurs during the operation of each of the artificial snowmakers.

With the above-described structure, it is easy to confirm a malfunction of an artificial snowmaker since the abnormality is displayed together with the location data of the artificial snowmaker.

According to still another embodiment, the system further includes an external monitoring device which is provided in an external monitoring station located in a remote place from skiing grounds. The external monitoring device is connected to the monitoring device in a monitoring station of a selected skiing ground so that the external monitoring device can monitor an operational state of each artificial snowmaker in the selected skiing ground.

With the above-described structure, it is possible to accurately monitor each artificial snowmaker in the selected skiing ground from the external monitoring station located in a remote place from skiing grounds, and therefore it is not always necessary to have maintenance staff stand by in each skiing ground.

According to still another embodiment, the system further comprises a means to reset an artificial snowmaker after it stops due to a malfunction.

With the above-described structure, it is possible to restart the operation of the artificial snowmaker without sending maintenance staff to the location since the causes of the artificial snowmaker stoppage can be found from the external monitoring station.

According to still another embodiment, the present invention provides a method of remotely monitoring artificial snowmakers, wherein the artificial snowmakers are placed apart from each other on a ski slope of a skiing ground, each of the artificial snowmakers having a freezer for making ice and being capable of making artificial snow independently, said method displaying a location of each of the artificial snowmakers on the ski slope on a monitoring screen in a monitoring station of the skiing ground, said monitoring screen displaying operational states of each of the artificial snowmakers at predetermined times.

According to still another embodiment, the present invention provides a method of remotely monitoring artificial snowmakers which are placed on a plurality of skiing grounds, wherein the artificial snowmakers are placed apart from each other on a ski slope of each of the skiing grounds, each of the artificial snowmakers having a freezer for making ice and being capable of making artificial snow independently, said method comprising the step of displaying an operational state of each of the artificial snowmakers in a selected skiing ground by making connection to the selected skiing ground from an external monitoring station located in a place remote from the skiing grounds, said method further comprising the step of displaying various parameters of an artificial snowmaker based on the displayed operation state when it operates abnormally.

The following Detailed Description of the Invention and attached drawings will explain more clearly the other features and remarkable effects of the present invention.

DETAILED DESCRIPTION OF THE PREFERRED EMBODIMENT

This section will describe each embodiment of the present invention based on the drawings.

Figure 1:
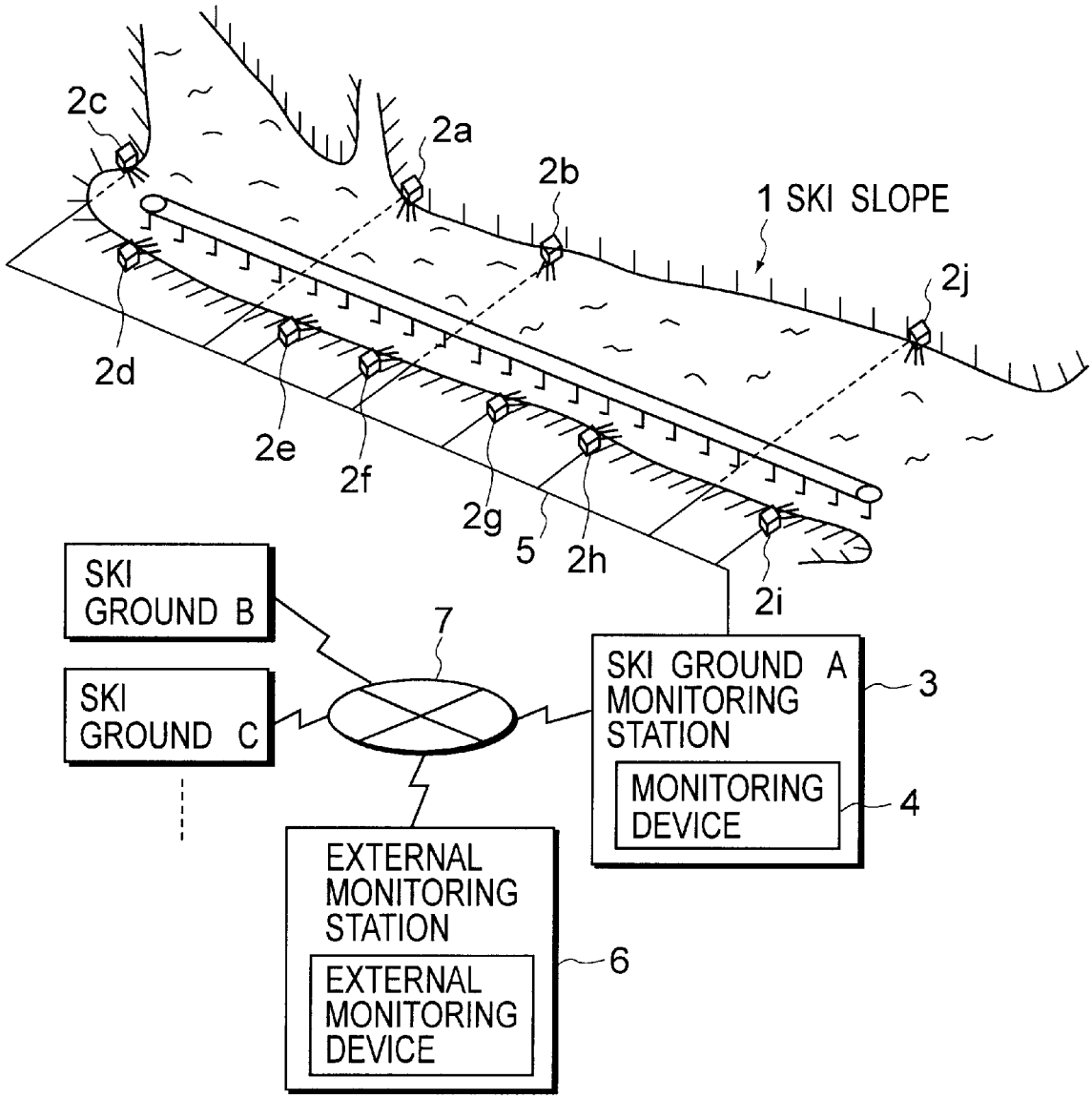
FIG. 1 is a schematic diagram illustrating an overall structure of an embodiment of the present invention.

FIG. 1 is a schematic view showing an entire slope 1 of skiing ground A.

In the case of the skiing ground A, ten artificial snowmakers 2*a* to 2*j* are placed at predetermined intervals along the slope 1. Here, these artificial snowmakers 2*a* to 2*j* are ice crushing systems (hereinafter abbreviated as "ICS") which make snow by finely crushing ice pieces. All the ICSs 2*a* to 2*j* are connected to a monitoring device 4 in a monitoring station 3 in the skiing ground A via a wire 5, or preferably by an optical cable so that they can be communicated in both directions. Furthermore, the monitoring device 4 is connected to an external monitoring station 6 located at a remote place from the skiing ground A via public telephone communication network 7. Therefore, the external monitoring station 6 is capable of collectively monitoring the skiing grounds A, B, C, . . . .

Figure 2:
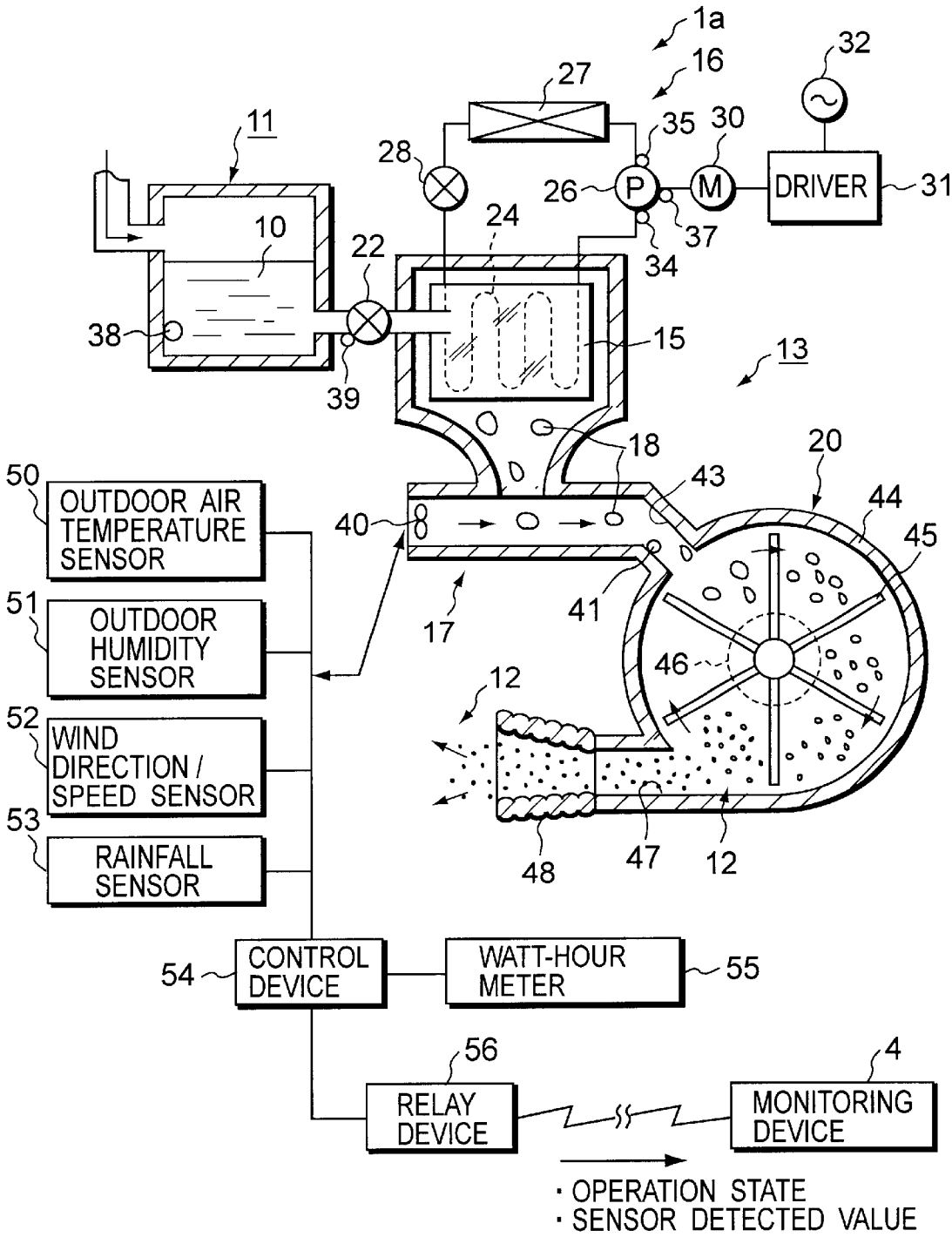
FIG. 2 is a schematic diagram illustrating the structure of an artificial snowmaker.

FIG. 2 is a diagram illustrating one (1*a*) of the ICSs, and the monitoring device 4 of the monitoring station 3.

First, the ICS (1*a*) will be described. The ICS (1*a*) includes a water storage tank 11 where water 10 is stored, and a snow making unit 13 which produces snow 12 from the freezing water 10 by turning it into ice pieces and finely crushing the ice pieces.

The snow making unit 13 further includes: a cooling plate 15 wherein the water supplied from the water storage tank 11 is frozen; a cooling device 16 cooling the cooling plate 15; a blower 17 conveying ice pieces 18 at a predetermined air blow pressure, the ice pieces 18 being produced by the cooling plate 15, and the blower 17 being connected to the cooling plate 15; and a crushing device 20 finely crushing the ice pieces 18 thereby making the artificial snow 12, the crushing device 20 being connected to one end of the blower 17.

The water storage tank 11 has functions of filtering and storing the snow-making water 10 such as tap water, rainfall water and snow-melted water, supplying the snow-making water 10 to the cooling plate 15, and controlling the amount of the water flow with a flow control valve 22. The shape of the cooling plate 15 is, for example, a drum shape. The surface of the cooling plate 15 is cooled by the cooling device 16 so that the temperature of the surface stays, for example, at 15° C. below zero. The water supplied to the cooling plate 15 is transformed into ice and attached to the surface of the cooling plate 15.

The cooling device 16 has a coolant tube 24 which is fixed onto the cooling plate 15. Due to heat exchange between a coolant flowing through the coolant tube 24 and the water 10, the water 10 is transformed into ice pieces 18. The cooling device 16 includes a compressor 26 for compressing the coolant which comes through the cooling plate 15, a condenser 27 (heat exchanger) for condensing the coolant which comes through the compressor 26, and an expanding valve 28 for expanding in an adiabatic manner the coolant which comes through the condenser 27. The cooling device 16 thus constitutes a freezing cycle where the coolant circulates in the above-described order.

The compressor 26 can be of any type such as a curled type or a scroll type, which is, for example, driven by a motor 30. The motor is connected to a power outlet 32 via a driver 31.

Furthermore, a low-pressure coolant pressure sensor 34 and a high-pressure coolant pressure sensor 35 are respectively installed at the suction side and the discharge side of the compressor 26. A lubricant temperature sensor 37 is installed inside the compressor 26 to detect the temperature of the lubricant for the compressor 26. In addition, the above-described water storage tank 11 includes a snow-making water temperature sensor 38 for detecting the temperature of the snow-making water, and a flow sensor 39 for detecting the amount of the snow-making water flow which is supplied.

The ice attached to the cooling plate 15 is chipped off with a knife-like blade or a regular blade, or peeled off by applying a hot gas whose temperature is from 70° C. to 80° C. to the cooling plate 15, thereby turning into ice pieces 18 of a predetermined size. Then, the ice pieces 18 are sent into the blower 17.

The blower 17 has a function of sending the ice pieces 18 to the crushing device 18 with an air blow pressure produced by an air blowing device 40. The air pressure at a connecting section between the blower 17 and the crushing device 20 is detected by a blower discharge pressure sensor 41.

The crushing device 20 includes a casing 44 having an ice piece inlet 43 which is connected to the blower 17, a crushing blade 45 being rotatably mounted inside the casing 44 so as to finely crush the ice pieces thereby making artificial snow 12, a rotational motor 46 for rotating the crushing blade 45 at high speed, and an artificial snow discharge outlet 47 for discharging the artificial snow 12 which has been already made.

More specifically, the ice pieces 18 sent by the blower 17 to the crushing device 20 are more finely crushed by the crushing blade 45, which rotates at high speed, being turned into the artificial snow 12 which is guided towards the artificial snow discharge outlet 47. The artificial snow 12 is then supplied to the ski slope via a snow conveying tube 48 which is connected to the discharge outlet 47.

The ICS (1*a*) is provided with various detectors for detecting the atmosphere surrounding the system. These are an outdoor air temperature sensor 50, an outdoor humidity sensor 51, a wind direction/speed sensor 52, and a rainfall gauge 53.

All of the sensors described above and the drivers for driving motors are connected to a control device 54. The control device 54 is designed to aggregate values detected by the sensors, and to control the ICS (1*a*) by external commands. The control device 54 is connected to a watt-hour meter 55, which detects watt-hour of the ICS (1*a*).

The control device 54 is connected to the monitoring device 4 in the monitoring station 3 via a relay device 56, so as to transmit data of the operational state of the ICS (1*a*) and the values detected by the sensors.

Figure 3:
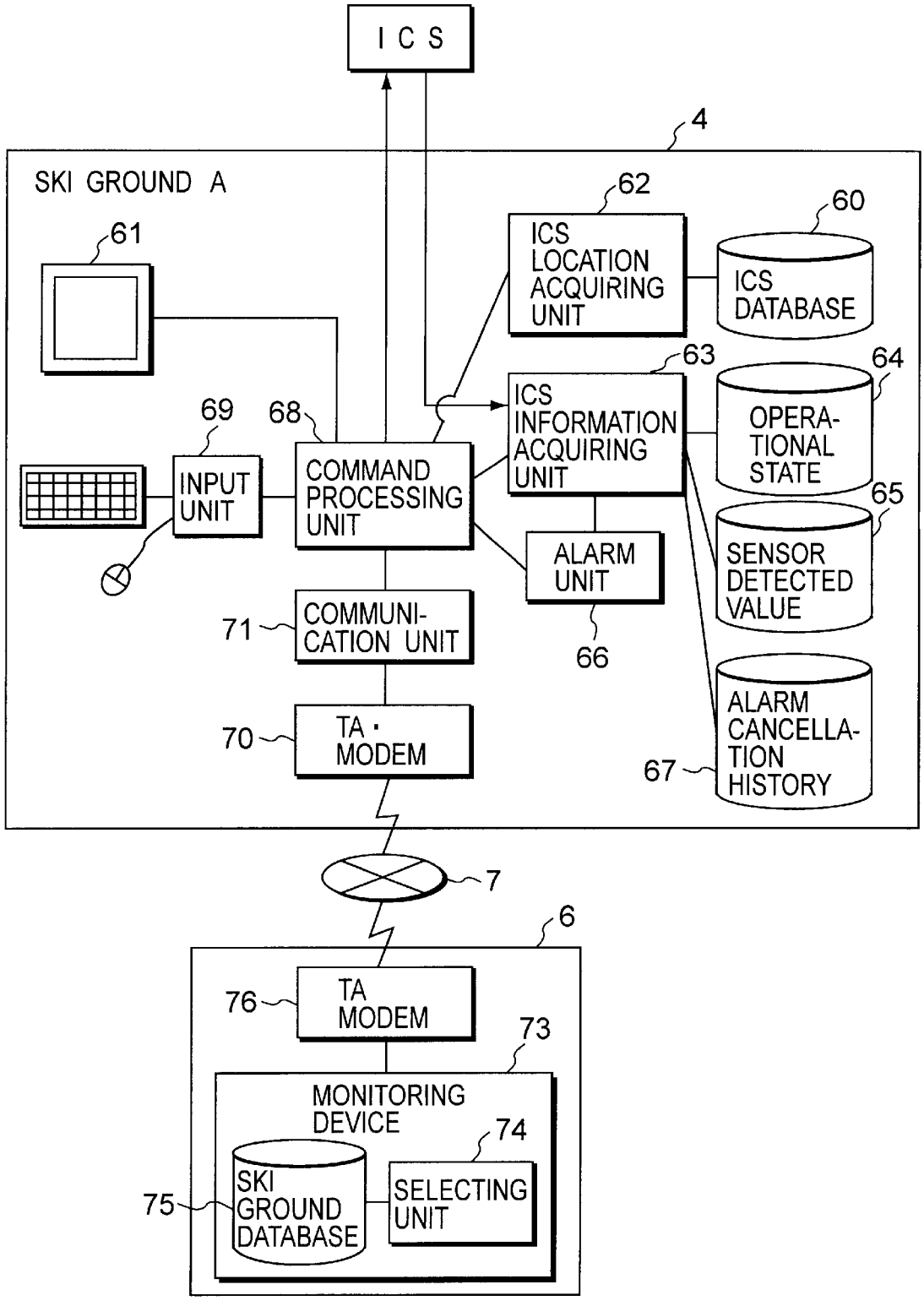
FIG. 3 is a schematic diagram illustrating the structure of a monitoring device.

The following section will describe the monitoring device 4 with reference to FIG. 3.

The monitoring device 4 includes an ICS data base 60 for registering/maintaining each artificial snowmaker, an ICS location acquiring unit 62 for acquiring the location of each ICS on the slope from the ICS data base 60 and displaying the data on a monitor 61, an ICS information acquiring unit 63 for acquiring the data of the operational state and the values detected by the sensors at certain intervals of time for each ICS, an operational state storage unit 64 for storing operational states which are received, a sensor detected value storage unit 65 for storing values detected by the sensors, an alarm unit 66 for displaying an alarm on the monitor 61 or the like based on the information received from each ICS, an alarm cancellation history storage unit 67 for storing an alarm cancellation history in the past, a command processing unit 68 for processing commands made by these structural elements, an instruction input unit 69 for giving various instructions to the structural elements and the control device 54 of the ICS, and a communication unit 71 for communicating with an external monitoring station 6 via a communication interface 70 such as a modem or TA (terminal adapter).

The external monitoring station 6 is provided with a monitoring device 73 having substantially the same structure as that of the monitoring device 4. The monitoring device 73 is provided with a skiing ground data base 75 for selecting the monitoring device 4 in one of the skiing grounds for selective communication. The monitoring device 73 is also provided with a selecting unit 74 for selecting a skiing ground for monitoring.

The next section will describe the operation of the above-described monitoring devices 4 and 73.

Figure 4:
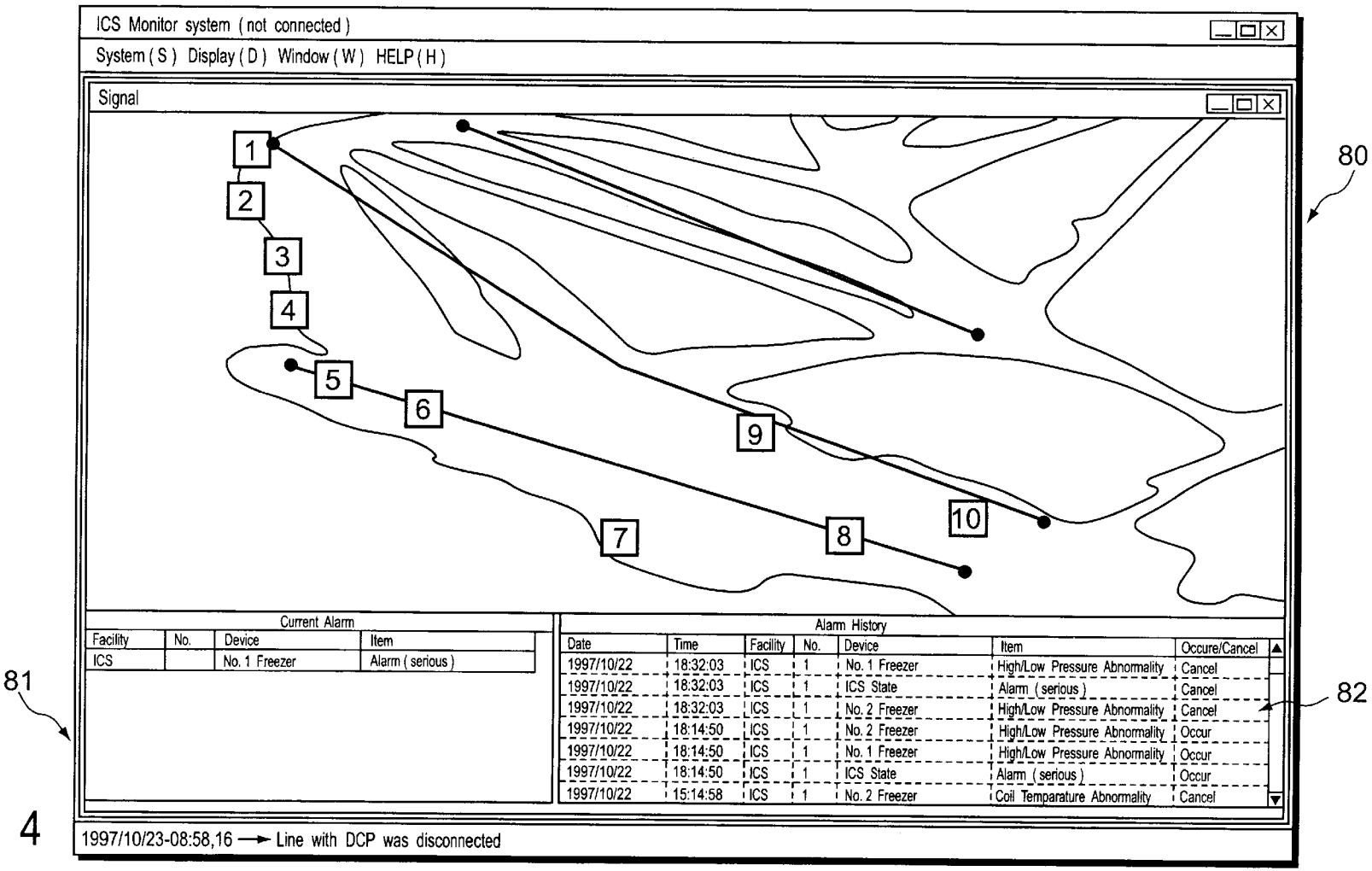
FIG. 4 is a diagram illustrating a screen display example of the monitoring device.

FIG. 4 is an example of a first screen image displayed on the monitor 61 when the monitoring device 4 of each skiing ground is started. More specifically, the ICS location acquiring unit 62 accesses the ICS data base 60 to acquire the location of each ICS on the slope, and the acquired information is displayed on the frame 80 set on the upper half of the screen. In this embodiment, the ICS numbers (1 to 10) are also displayed on the schematic diagram of the skiing ground.

Furthermore, the lower left section of the same screen displays an alarm display column 81 showing a present alarm occurrence in the skiing ground, and the lower right section displays the history of alarm occurrences 82 in the form of a table. More specifically, the ICS information acquiring section 63 acquires sensor detected values and an operational state from each ICS every 10 minutes, for example, and stores them in the sensor detected value storage unit 65 and the operational state storage unit 64 respectively. Furthermore, depending on the operational state of the ICS, the alarm unit 26 indicates an alarm of "serious degree" in the alarm display column 81 when the operation of the ICS stops, or it indicates an alarm of "not serious degree" when the detected parameter value falls outside a predetermined range. In this example shown in FIG. 4, the alarm display column 81 displays an alarm of serious degree, indicating that the operation of the ICS 1 is suspended.

The alarm of serious degree is canceled when the ICS restarts its operation. The ICS is restarted when monitoring staff inputs a start command to the control device of the ICS via the command processing unit 68 from the input unit 69 after confirming that the sensor detected values are back to normal. On the other hand, the cancellation of the alarm of "not serious degree" is made automatically when the detected parameter value returns to the predetermined range. The alarm cancellation history is stored in the alarm cancellation history storage unit 67, and is also displayed in the alarm cancellation history display column 82 on the screen.

Figure 5:
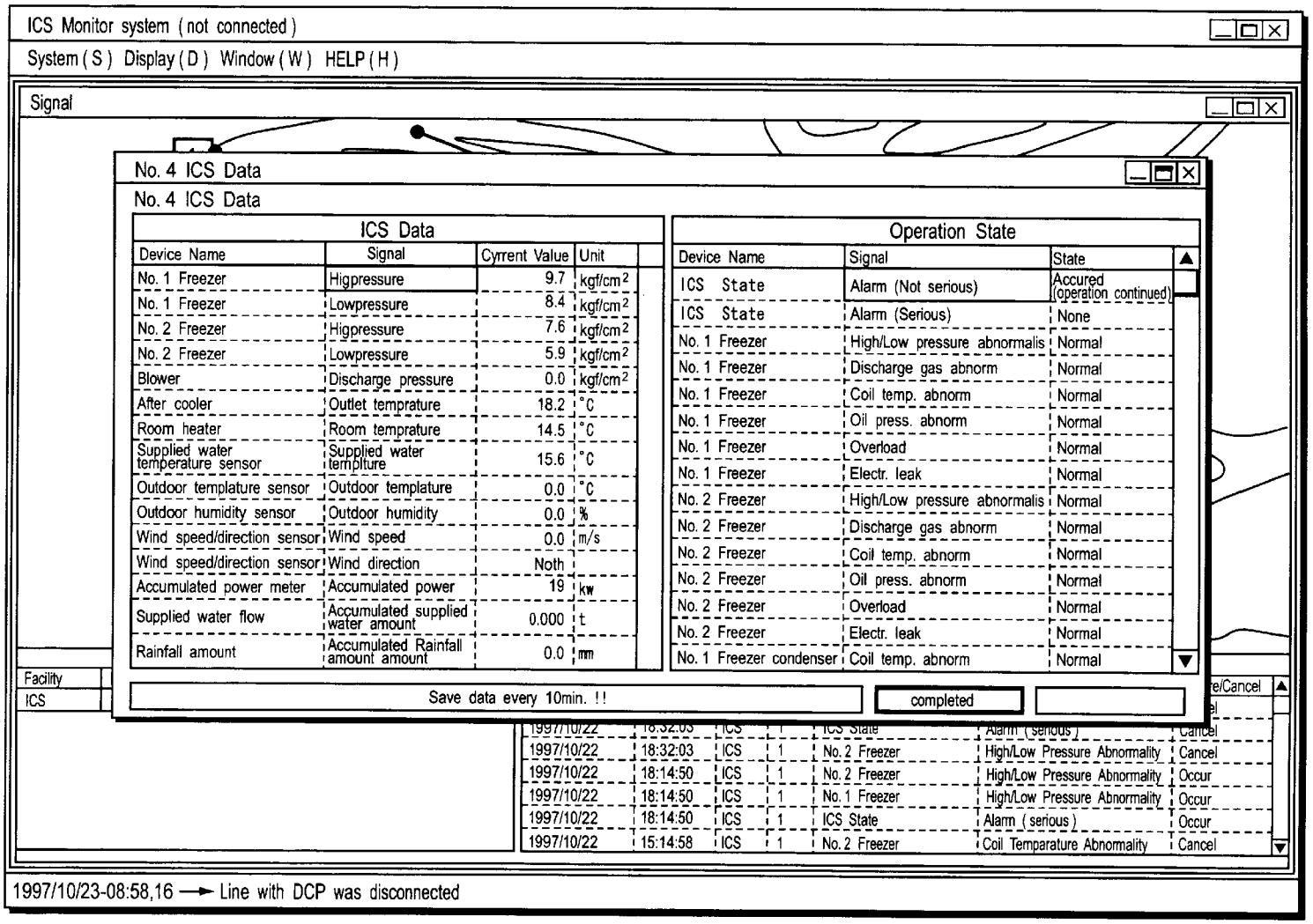
FIG. 5 is a diagram illustrating a screen display example of the monitoring device.

In addition, the alarm unit can notify alarms by blinking the ICS numbers which are displayed over the slope screen in the frame 80 of the upper half of the screen, or by changing the color of the ICS numbers into that of alarm. More specifically, the color of an ICS number is green when its operation is normal. A yellow color indicates an alarm of not-serious degree, and a flushing red color indicates an alarm of serious degree. Here, if the monitoring staff double-clicks one of the ICS numbers in question on the screen, the ICS data acquiring unit 63 picks up each sensor detected value (ICS data) of the selected ICS as well as detailed information on the operational state, and displays them on the screen as shown in FIG. 5.

By examining the detailed information, the monitoring staff can determine whether or not he/she should go to check up the ICS, and can make an appropriate preparation for the check-up if it is necessary. If the sensor detected values get back to normal while the ICS operation is suspended, the ICS can be restarted as described previously without any staff going to the site.

Furthermore, in this embodiment, it is possible to monitor each of the ICSs from the external monitoring station 6 located in a remote place from the skiing ground with almost the same accuracy as from the monitoring station 3 located within the skiing ground. In this case, the skiing ground selecting unit 74 (see FIG. 3), which is provided in the monitoring device 73 of the external monitoring station 6, displays a skiing ground selection screen as shown in FIG. 6 to monitoring staff.

The screen displays a list 85 of the skiing grounds registered in the skiing ground database 75. The monitoring staff selects a desired skiing ground, which is then highlighted in reverse-background display. By pressing a dial button 86, the screen is connected on-line to the monitoring device 4 of the selected skiing ground via the communication interface 76 and the public telephone network 7. Thus, the monitoring device 73 of the external monitoring station 6 can copy the data in the operational state storage unit 64 and the sensor detected data storage unit 65 into its own storage unit (not shown in the figure). In this manner, the monitoring condition similar to that of the monitoring station 3 located within the skiing ground can be achieved.

Figure 6:
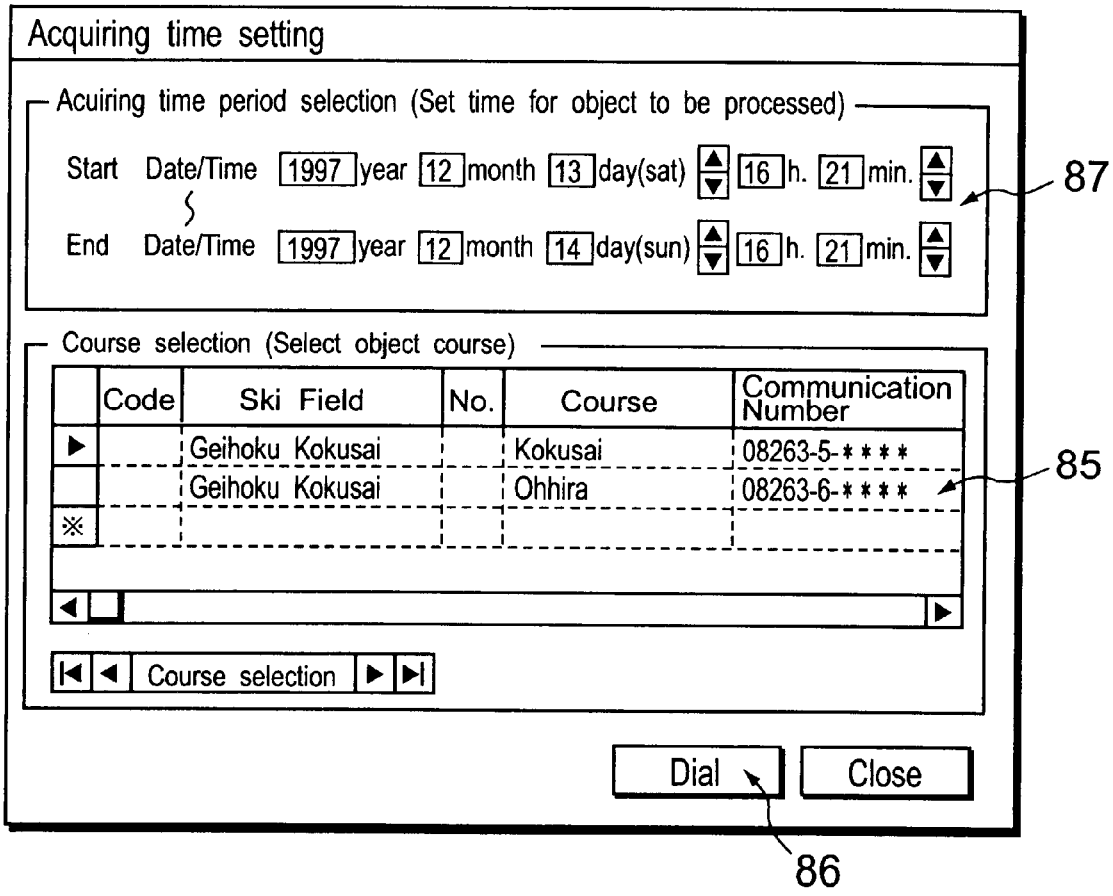
FIG. 6 is a diagram illustrating a screen display example of an external monitoring device.

Furthermore, the screen shown in FIG. 6 includes a designation column 87 for a data acquiring time period, wherein a data acquiring time period can be designated. Furthermore, when an alarm is detected in a skiing ground, the skiing ground selecting unit 74 automatically selects the skiing ground and makes the connection thereto so as to start the monitoring device 73. Alternatively, all the data may be acquired once a day automatically.

According to the above-described structure, appropriate monitoring can be conducted without having full-time monitoring staff in each skiing ground. In addition, it is possible to send maintenance staff to a selected skiing ground based on the observation at the external monitoring station.

The aforesaid embodiments are intended to clarify technical meaning of the present invention. Therefore, the present invention is not intended to be limited to the above concrete embodiments and to be interpreted in a narrow sense, and various changes may be made therein without departing from the spirit of the present invention and within the meaning of the claims.

What is claimed is:

1. A system for remotely monitoring artificial snowmakers, comprising:

a plurality of artificial snowmakers placed apart from each other on a slope of a skiing ground, each of said artificial snowmakers having a freezer for making ice, and being capable of independently making artificial snow by crushing the ice; and a monitoring device provided in a monitoring station of said skiing ground and connected to each of said artificial snowmakers, for monitoring an operational state of each of the freezers in the respective artificial snowmakers and an atmosphere surrounding the artificial snowmakers.

2. A monitoring system according to claim 1, wherein said monitoring device is connected to a sensor provided in each of said artificial snowmakers, said sensor comprising at least an atmosphere detection sensor for detecting an atmosphere surrounding an artificial snowmaker and a pressure sensor for detecting a coolant pressure of said freezer, said monitoring device comprising:

a sensor detected value display means for displaying a value detected by each of said sensors and an operational state display means for displaying an operational state of each of the freezers in the respective artificial snowmakers.

3. A monitoring system according to claim 2, wherein said monitoring device further comprises a time series display means for displaying said sensor detected values and said operational states in a time series.

4. A monitoring system according to claim 2, wherein said sensor further comprises a temperature sensor for detecting temperature of lubricant for a compressor of said freezer.

5. A monitoring system according to claim 1, wherein said monitoring device further comprises:

a location display device for displaying a location of each of said artificial snowmakers; and abnormality display device for displaying a sign indicating an abnormality on said location display device when some abnormality occurs in an operational state of each of said artificial snowmakers.

6. A system for remotely monitoring artificial snowmakers placed on a plurality of skiing grounds, comprising:

a plurality of artificial snowmakers placed apart from each other on a ski slope of each of said skiing grounds, each of said artificial snowmakers having a freezer for making ice and being capable of independently making artificial snow by crushing the ice;

a monitoring device provided in a monitoring station of each of said skiing grounds and connected to each of the artificial snowmakers in a skiing ground for monitoring an operational state of each of the artificial snowmakers in the skiing ground; and an external monitoring device provided in an external monitoring station located in a place remote from said skiing grounds, and connected to said monitoring device in the monitoring station of a selected skiing ground for monitoring an operational state of each of the artificial snowmakers in the selected skiing ground.

7. A monitoring system according to claim 6, further comprising a means for resetting an artificial snowmaker which is suspended due to a malfunction.

8. A method of remotely monitoring artificial snowmakers, wherein said snowmakers are placed apart from each other on a ski slope of a skiing ground, each of said artificial snowmakers having a freezer for making ice and being capable of independently making artificial snow by crushing the ice, said method comprising the steps of:

displaying a location of each of said artificial snowmakers on a monitor in a monitoring station in said skiing ground; and displaying operational states of each of said artificial snowmakers at predetermined times.

9. A monitoring method according to claim 8, further comprising the step of displaying values detected by various sensors provided in each of said artificial snowmakers when an abnormality occurs with an artificial snowmaker.

10. A monitoring method of remotely monitoring artificial snowmakers placed on a plurality of skiing grounds, wherein said artificial snowmakers are placed apart from each other on a ski slope of each of said skiing grounds, each of said artificial snowmakers having a freezer for making ice and being capable of independently making artificial snow by crushing the ice, said method comprising the step of displaying an operational state of each of said artificial snowmakers in a selected skiing ground by making connection to the selected skiing ground from an external monitoring station remote from said skiing grounds, said method further comprising the step of displaying various parameters of an artificial snowmaker based on the displayed operational state when the artificial snowmaker operates abnormally.

11. A monitoring method according to claim 10, further comprising the step of resetting said artificial snowmaker based on the displayed operational state when the artificial snowmaker is suspended due to an abnormality.

* * * * *